US006558129B2

(12) United States Patent
Wang

(10) Patent No.: US 6,558,129 B2
(45) Date of Patent: May 6, 2003

(54) AIR PUMP HAVING PRESSURE GAUGE THEREON

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 12 days.

(21) Appl. No.: 09/973,881

(22) Filed: Oct. 11, 2001

(65) Prior Publication Data

US 2003/0039553 A1 Feb. 27, 2003

(51) Int. Cl.[7] ..... F04B 49/00
(52) U.S. Cl. ..... 417/63
(58) Field of Search ..... 417/63, 448, 572

(56) References Cited

U.S. PATENT DOCUMENTS 3,921,977 A * 11/1975 Brink ..... 222/4
D323,876 S * 2/1992 Furusawa ..... D23/231
5,201,213 A * 4/1993 Henning ..... 73/49.2
5,318,317 A * 6/1994 Hopper ..... 280/201
5,363,665 A * 11/1994 Sundman ..... 62/125
5,782,198 A * 7/1998 Sinclair et al. ..... 116/139
5,788,463 A * 8/1998 Chan ..... 417/63
5,964,577 A * 10/1999 Chuang ..... 417/63
6,079,954 A * 6/2000 Kownacki et al. ..... 417/63

* cited by examiner

*Primary Examiner*—Charles G. Freay
*Assistant Examiner*—William H. Rodriguez
(74) *Attorney, Agent, or Firm*—Browdy and Neimark, P.L.L.C.

(57) ABSTRACT

An air pump comprises a base with footplate, an upright cylinder upwardly extended from the base, a inflation piston unit for reciprocating motion in the upright cylinder to pump air out of the upright cylinder, a flexible air tube connected to the upright cylinder, an inflation nozzle connected to one end of the flexible air tube for output of compressed air, and a pressure gauge mounted in a chamber in the base and disposed in air communication with the upright cylinder and adapted to measure the pressure of air of an inflatable device to which the inflation nozzle is fastened. The pressure gauge has a face marked with indication signs in the negative form, and a cover hinged to the base and adapted to close the pressure gauge. The cover has a mirror disposed at an inner side and adapted to reflect the image of the reading of the indication signs of the pressure gauge.

7 Claims, 4 Drawing Sheets

AIR PUMP HAVING PRESSURE GAUGE THEREON

FIELD OF THE INVENTION

The present invention relates to an air pump, and more particularly to an air pump provided with a pressure gauge thereon.

BACKGROUND OF THE INVENTION

A variety of hand-held vertical air pumps have been disclosed for use to inflate bicycle tires, balls, etc., and have appeared on the market. There are also known vertical air pumps having a pressure gauge. Because the pressure gauge of a vertical air pump is exposed to the outside for easy reading, it tends to be damaged by an impact or external objects. Further, the installation of the pressure gauge greatly increases the dimensions of the vertical air pump, and also greatly complicates the fabrication procedure of the air pump.

SUMMARY OF THE INVENTION

It is therefore the primary objective of the present invention to provide to an air pump having a pressure gauge thereon, which has means to protect the pressure gauge against impact of external objects.

It is another objective of the present invention to provide an air pump having a pressure gauge thereon, which has a compact structure arrangement to decrease the total volume of the air pump.

It is still another objective of the present invention to provide an air pump having a pressure gauge thereon, which is easy to manufacture, and convenient to carry.

In keeping with the principle of the present invention, the foregoing objectives of the present invention are attained by the air pump comprising a base with foot positioning means, an upright cylinder upwardly extended from the base, a inflation piston unit for reciprocating motion in the upright cylinder to pump air out of the upright cylinder, a flexible air tube connected to the upright cylinder, an inflation nozzle connected to one end of the flexible air tube for output of compressed air, and a pressure gauge mounted in a chamber in the base and disposed in air communication with the upright cylinder and adapted to measure the pressure of air of the inflatable device to which the inflation nozzle is fastened, wherein the base comprises a receiving chamber, the receiving chamber having an open side; the pressure gauge is fixedly mounted in the receiving chamber, having a face marked with indication signs in the negative form and facing the open side; a cover is hinged to the base at a bottom side of the receiving chamber and adapted to close the open side of the receiving chamber, the cover having a mirror fixedly mounted in an inner side thereof and adapted to reflect the image of the reading of the indication signs of the pressure gauge.

DETAILED DESCRIPTION OF THE INVENTION

Figure 1:
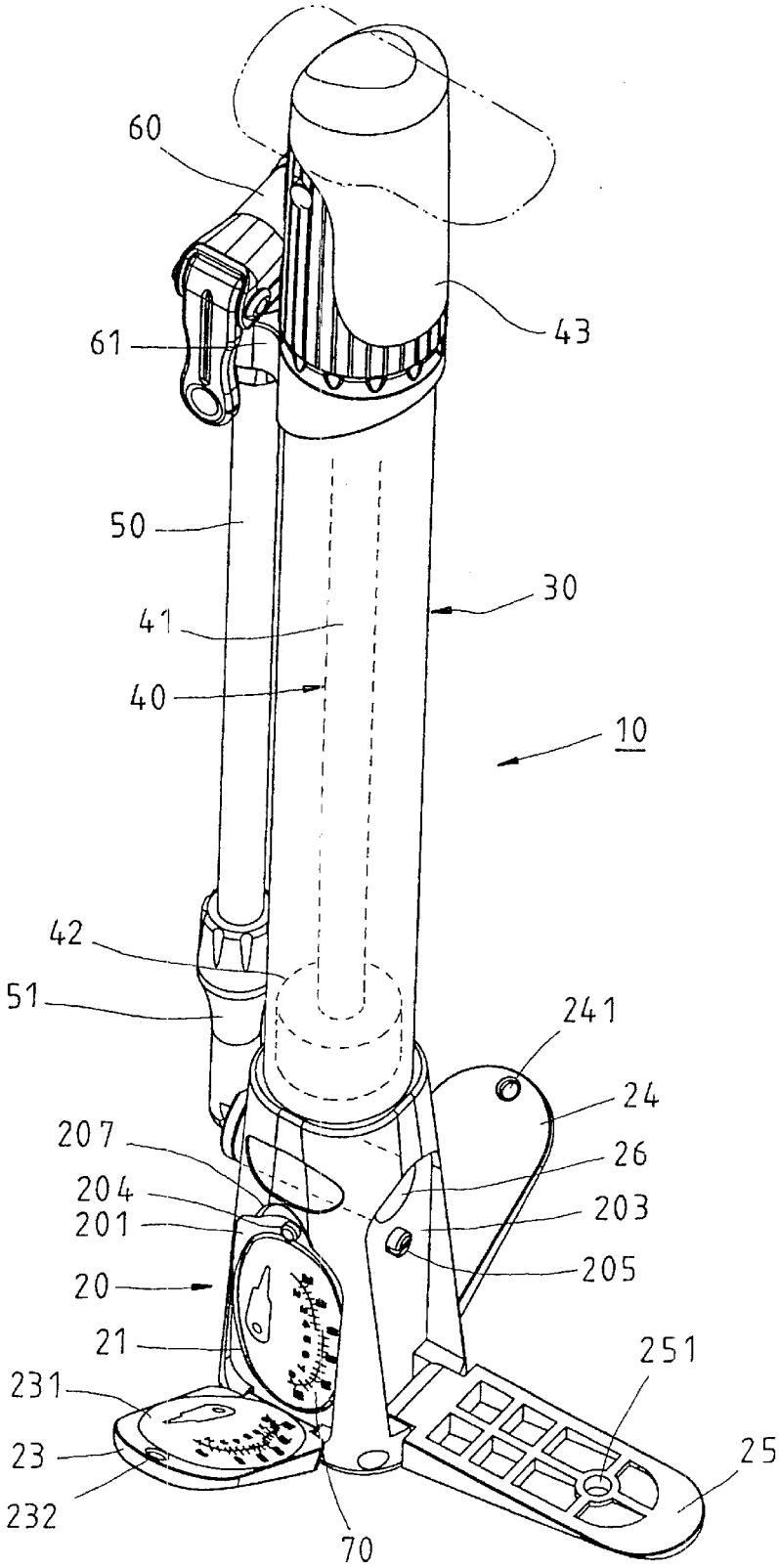
FIG. 1 is a perspective view of an air pump according to a first preferred embodiment of the present invention.
Figure 2:
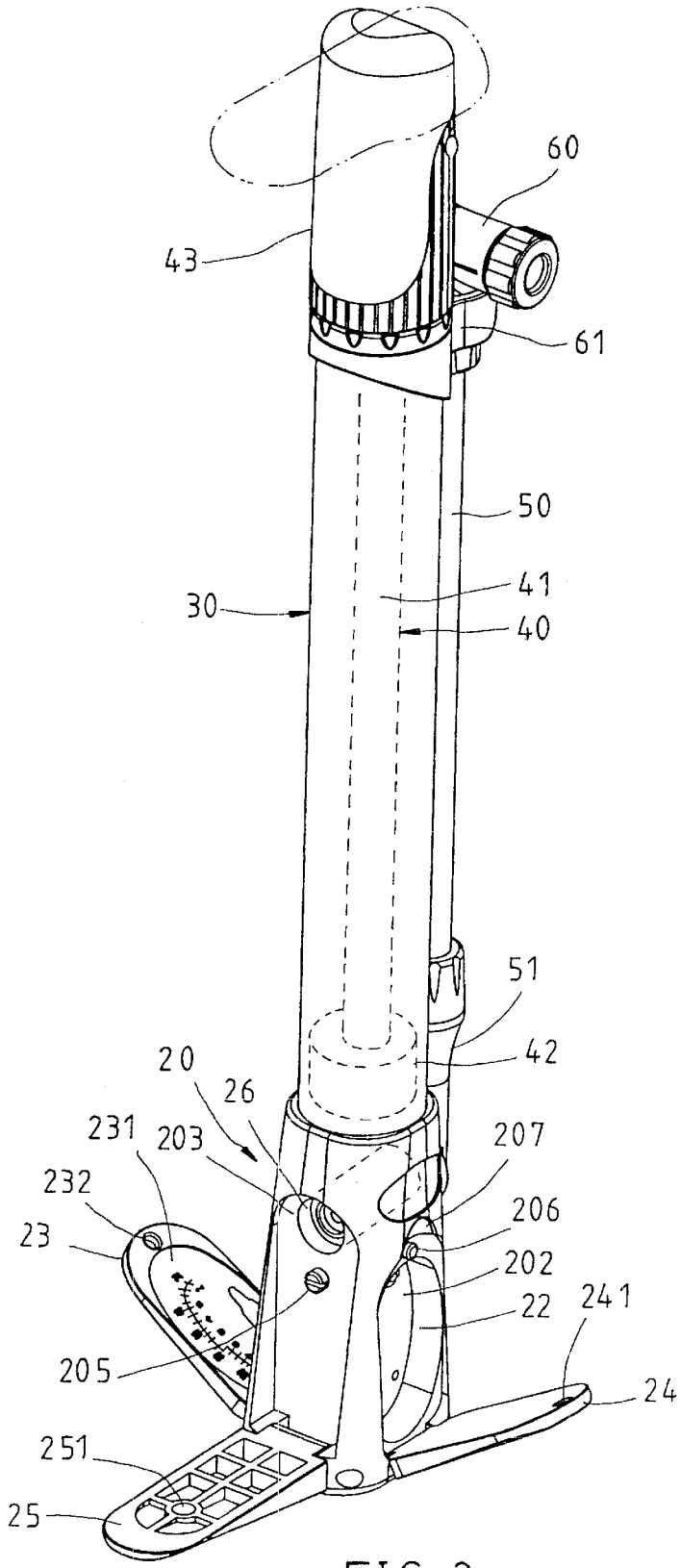
FIG. 2 is another perspective view of the air pump according to the preferred embodiment of the present invention when viewed from another angle.

As shown in FIGS. 1–2, an air pump 10 of the first preferred embodiment of the present invention comprises a base 20, an upright cylinder 30 fixedly fastened to the base 20 at the top, a inflation piston unit 40 inserted into the upright cylinder 30, a flexible air tube 50 connected to the bottom end of the upright cylinder 30, an inflation nozzle 60 connected to one end of the flexible air tube 50 remote from the upright cylinder 30, and a pressure gauge 70 mounted in the base 20. The structure and function of the upright cylinder 30, the inflation piston unit 40, the flexible air tube 50, and the inflation nozzle 60 are similar to the like members of a conventional air pump. The main features of the present invention are at the base 20 and the pressure gauge 70.

Figure 3:
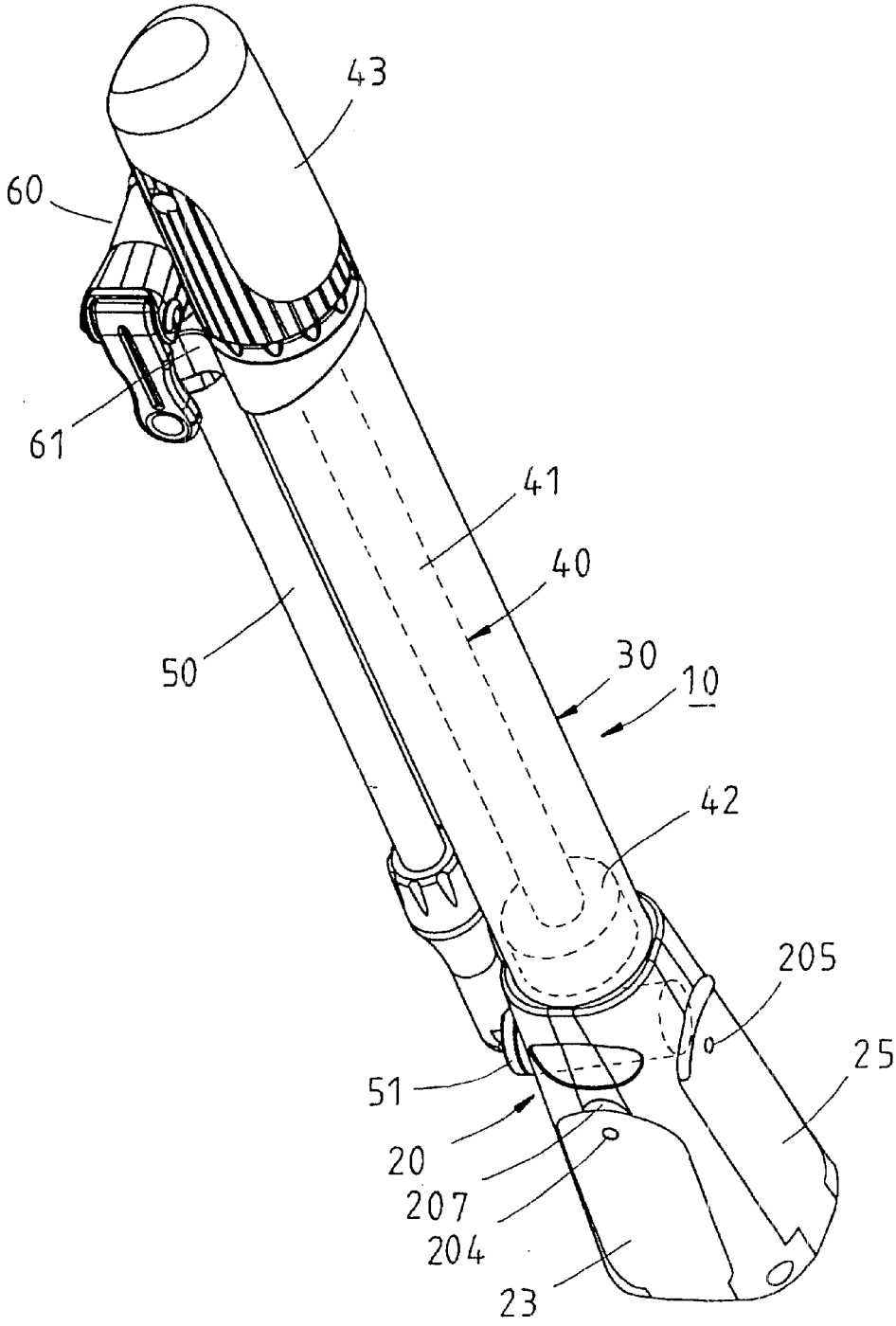
FIG. 3 is another perspective view of the preferred embodiment of the present invention showing that the air pump is not in use.

The base 20 is shaped like a conical prism, having flat recesses, namely, the front recess 201, the back recess 202 and the side recess 202 respectively disposed at the front, back, and right sidewalls of the base 20, a receiving chamber 21 in the front recess 201, a tool chamber 22 in the back recess 202, a front cover 23 hinged to the bottom side of the front recess 201 and adapted to close the receiving chamber 21, a back cover 24 hinged to the bottom side of the back recess 202 and adapted to close the tool chamber 22, and a footplate 25 hinged to the bottom side of the side recess 203. The front cover 23 has a mirror 231 embedded in the inner sidewall thereof. The front cover 23, the back cover 24 and the footplate 25 can be respectively turned between a horizontal position, namely, the extended position, and a vertical position, namely, the closed position. When closed, the front cover 23, the back cover 24 and the footplate 25 are disposed in flush with the periphery of the base 20, as shown in FIG. 3. Raised retaining portions 204, 205 and 206 are respectively provided in the front recess 201 above the receiving chamber 21, the back recess 202 above the tool chamber 22, and the side recess 202. The front cover 23, the back cover 24 and the footplate 25 have a respective recessed retaining hole 232, 241 and 251 corresponding to the raised retaining portions 204, 205 and 206. When turned the front cover 23, the back cover 24 and the footplate 25 from the respective extended position to the respective closed position, the recessed retaining hole 232, 241 and 251 are respectively forced into engagement with the raised retaining portions 204, 205 and 206, keeping the front cover 23, the back cover 24 and the footplate 25 in the respective closed position. A finger notch 207 is provided at the top side of each of the front recess 201 and back recess 202 for the insertion of the finger to open the front cover 23 from the receiving chamber 21 or the back cover 24 from the tool chamber 22. The footplate 25 has its free end (the end remote from the pivoted area between the footplate 25 and the side recess 203) curved outwards through which the user can pull the footplate 25 outwards from the side recess 203 to the extended position with the fingers. Further, the front cover 23 can be freely set in any angular position within 90° between the extended position and the closed position due to the effect of friction resistance in the pivoting structure between the front cover 23 and the front recess 201. The base 20 further comprises a transverse through hole 26, and a vertical hole (not shown) perpendicularly downwardly extended from the mid portion of the transverse through hole 26 to the receiving chamber 21.

The upright cylinder 30 has a bottom end fixedly connected to the top of the base 20 (according to the present preferred embodiment, the upright cylinder 30 and the base 20 are integrally injection-molded from plastics) and a bottom center hole (not shown) in air communication with the transverse through hole 26 of the base 20.

The inflation piston unit 40 is comprised of a main rod 41, a piston 42 fixedly provided at one end of the main rod 41 and inserted with the main rod 41 into the upright cylinder 40, and a handle 43 fixedly provided at the other end of the main rod 41 and disposed outside the upright cylinder 30. According to the present preferred embodiment, the handle 43 is pivoted to the main rod 41, and can be alternatively set between the operative position where the handle 43 is disposed perpendicular to the main rod 41, and the non-operative position where the handle 43 is closely attached to the periphery of the main rod 41. When pulling the handle 43 with the hands to lift the main rod 41 and the piston 42, outside air passes from the top end of the upright cylinder 30 into the inside space of the upright cylinder 30 below the piston 42. On the contrary, when pushing the piston 42 downwards, air is compressed and forced out of the upright cylinder 30 through the flexible air tube 50.

The flexible air tube 50 has one end connected to the bottom side of the upright cylinder 30 and adapted to receive compressed air from the upright cylinder 30 upon down stroke of the piston 42, and an opposite end connected to the inflation nozzle 60. According to the present preferred embodiment, a swivel angle connector 51 is fixedly fastened to one end of the flexible air tube 50 and coupled to the transverse through hole 26 of the base 20, for enabling the flexible air tube 50 to receive compressed air from the upright cylinder 30, and to be turned with the swivel angle connector 51 relative to the base 20 to the desired angle.

The inflation nozzle 60 is fixedly connected to the other end of the flexible air tube 50 remote from the base 20, for connection to the air valve of an inflatable device for enabling compressed air to be filled into the inflatable device. The upright cylinder 30 further comprises a nozzle boot 61 near the topside for the resting of the inflation nozzle 60 when not in use.

The pressure gauge 70 is embedded in the receiving chamber 21 of the base 20, and disposed in a vertical position right below the upright cylinder 30. The face of the pressure gauge 70 is disposed in flush with the front recess 201. The numerical signs on the face of the pressure gauge 70 are printed in the negative form (like the negative form of the signs of a stamp) so that the user can see the image of the numerical signs of the face of the pressure gauge 70 in the normal form from the mirror 231.

When in use, the base 20 of the air pump 10 is placed on the floor, and then the footplate 25 is pulled out of the side recess 203 and pressed on the floor with the foot, and then the handle 43 is turned from the non-operative position to the operative position and operated with the hands to reciprocate the main rod 41 and the pump piston 42 in the upright cylinder 30, causing compressed air to be continuously pumped into the inflatable device through the flexible air tube 50 and the inflation nozzle 60 (this action is similar to a conventional air pump; as indicated above, the upright cylinder 30, the inflation piston unit 40, the flexible air tube 50, and the inflation nozzle 60 are similar to the like members of a conventional air pump, not the key points within the scope of the claims of the present invention).

In order to monitor the air pressure of the inflatable device during pumping, the user can open the front cover 23, keeping the pressure gauge 70 at the front side (facing the user). When opened the front cover 23, the mirror 231 is held with the front cover 23 at the desired angle relative to the pressure gauge 70. When pumping, the user can see the image of the indication of the pressure gauge 70 in the positive form from the mirror 231. Because the front cover 23 can be set in any angle between the vertical (closed) position and the horizontal (extended) position, the user can adjust the angular position of the mirror 231 with the front cover 23 relative to the pressure gauge 70 subject the body height.

When not in use, the front cover 23, the back cover 24 and the footplate 25 are closed to reduce the storage space of the air pump 10, and to well protect the pressure gauge 70. FIG. 3 shows the air pump 10 set in the received condition convenient for carrying on a bicycle. The air pump 10 according to the aforesaid embodiment is suitable for use to inflate bicycle tires. Further, bicycle repair tools and implements may be stored in the tool chamber 22 inside the base 20 of the air pump 10.

Figure 4:
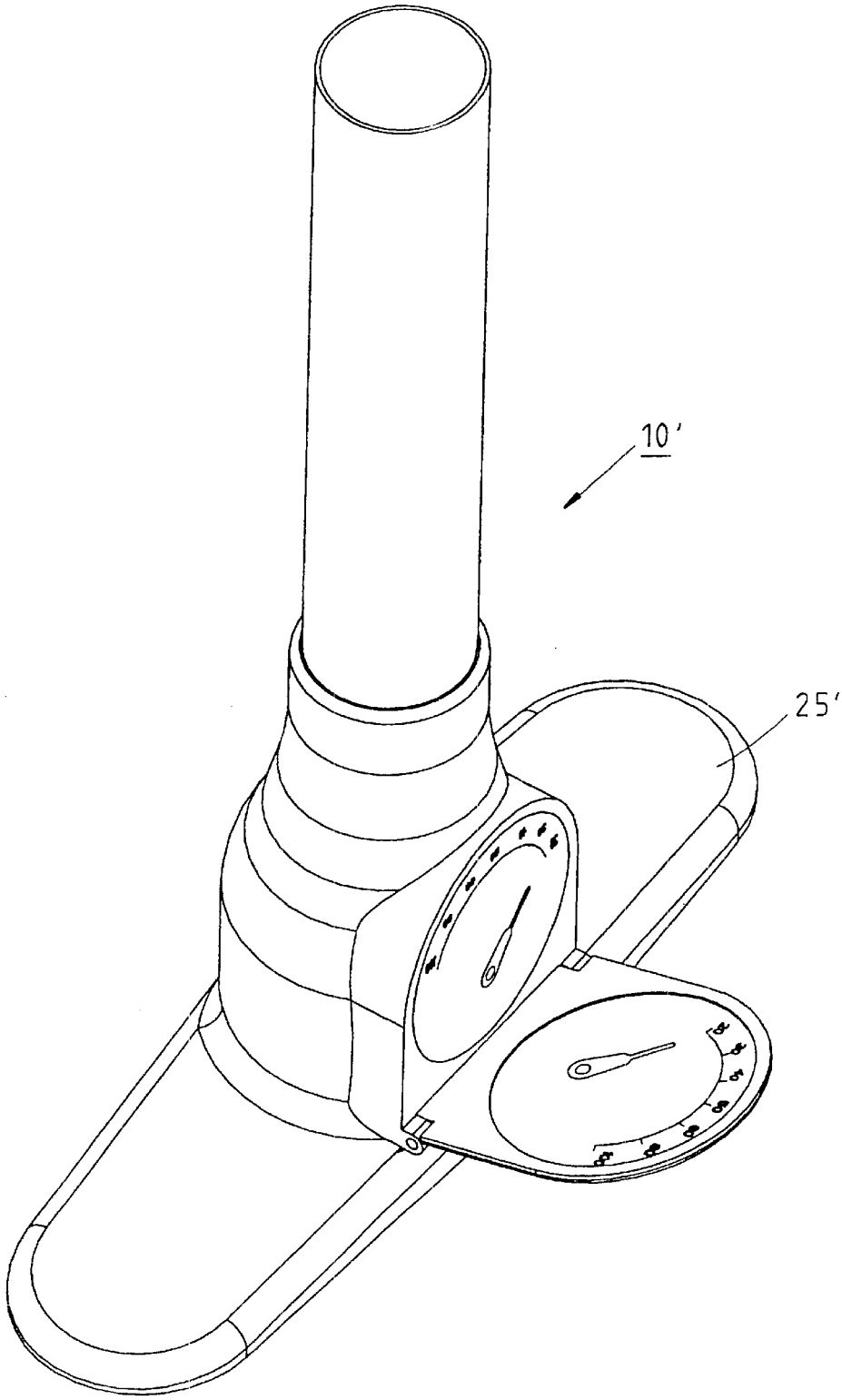
FIG. 4 is a perspective view of the base of an air pump according to a second preferred embodiment of the present invention.

FIG. 4 shows an alternate form of the present invention. According to this alternate form, the air pump 10' has two footplates 25' respectively hinged to the base at two opposite sides. When in use, the footplates 25' are respectively extended out, and held down on the floor with the two feet.

What is claimed is:

1. An air pump comprising:

a base having at least one footplate for the positioning of the user's foot and a receiving chamber having an open side;

an upright cylinder upwardly extended from said base;

an inflation piston unit inserted into said upright cylinder and adapted to pump air out of said upright cylinder when reciprocated in said upright cylinder by the user;

a flexible air tube having a first end connected to said upright cylinder and adapted to receive compressed air from said upright cylinder and a second end;

an inflation nozzle connected to the second end of said flexible air tube for output of compressed air to an inflatable device to be inflated;

a pressure gauge disposed in air communication with said flexible air tube and said upright cylinder and adapted to measure the pressure of air of the inflatable device to which said inflation nozzle is fastened, said pressure gauge is fixedly mounted in said receiving chamber of the base, having a face marked with indication signs in the negative form and facing said open side of the receiving chamber; and a cover is hinged to said base at a bottom side of said receiving chamber and adapted to close the open side of said receiving chamber, said cover having a mirror fixedly mounted in an inner side thereof and adapted to reflect the image of the reading of the indication signs of said pressure gauge.

2. The air pump as claimed in claim 1, wherein said cover is so hinged to said base that a friction resistance is produced to hold said cover in one of a series of angular positions when the user turned said cover out of the open side of said receiving chamber.

3. The air pump as claimed in claim 1, wherein said base has a flat recess surrounding the open side of said receiving chamber, a raised retaining portion disposed in said flat recess above the open side of said receiving chamber and adapted to lock said cover when said cover closed on the open side of said receiving chamber, and a finger notch disposed in a top side of said flat recess into which the user inserts the fingers to open said cover from the open side of said receiving chamber; said cover has a recessed retaining hole, which is forced into engagement with said raised retaining portion of said base to secure said cover in position once said cover has been closed on the open side of said receiving chamber.

4. The air pump as claimed in claim 1, wherein said base comprises a flat recess in the periphery thereof at one side opposite to said receiving chamber, a tool chamber in said flat recess, a raised retaining portion disposed in said flat recess above said tool chamber, a finger notch at a top side of said flat recess, and a tool chamber cover hinged to a bottom side of said flat recess and adapted to close said tool chamber, said tool chamber cover having a recessed retaining hole, which is forced into engagement with said raised retaining portion to lock said tool chamber cover in position when said tool chamber cover closed on said tool chamber.

5. The air pump as claimed in claim 1, wherein said footplate hinged to said base and set between an extended position where said footplate is disposed perpendicular to said upright cylinder, and a received position where said footplate is attached to the periphery of said base.

6. The air pump as claimed in claim 5, wherein said base comprises a flat recess adapted to receive said footplate, and a raised retaining portion disposed in said flat recess; said footplate comprises a recessed retaining hole, which is forced into engagement with said raised retaining portion when said footplate turned to said received position.

7. The air pump as claimed in claim 1, wherein said base comprises two footplates respectively fixedly fastened to said base at two opposite sides and extended in direction perpendicular to said upright cylinder.

* * * * *